US005097543A

United States Patent [19]

Oille

[11] Patent Number: 5,097,543

[45] Date of Patent: Mar. 24, 1992

[54] SHOWER DOOR

[75] Inventor: Fred J. Oille, Mississauga, Canada

[73] Assignee: Waterline Products Co. Ltd., Mississauga, Canada

[21] Appl. No.: 622,583

[22] Filed: Dec. 3, 1990

[51] Int. Cl.[5] ..... A47K 3/22; E05D 15/00

[52] U.S. Cl. ..... 4/607; 4/612; 4/557; 4/610; 160/210

[58] Field of Search ..... 4/607, 605, 608, 612, 4/614, 610, 557; 160/210, 213, DIG. 6, 229.1, 234, 185

[56] References Cited

U.S. PATENT DOCUMENTS 2,048,909 7/1936 Woodworth ..... 4/557

4,981,164 1/1991 Reichel ..... 4/610

FOREIGN PATENT DOCUMENTS 48809 9/1988 United Kingdom ..... 4/607

*Primary Examiner*—Henry J. Recla

*Assistant Examiner*—David J. Walczak

*Attorney, Agent, or Firm*—Kenneth M. Garrett

[57] ABSTRACT

A shower door assembly of the frameless type comprises light plastic panels interconnected substantially along their length by hinges which include channels for gripping the panels. An elongated bracket facilitates the attachment of the door to walls that are out of square in relation to a bath or shower pan. The assembly presents a smooth appearance substantially devoid of surface obstructions.

18 Claims, 2 Drawing Sheets

SHOWER DOOR

FIELD OF THE INVENTION

This invention relates to hinged shower doors. It particularly relates to shower doors of a trackless type.

BACKGROUND OF THE INVENTION

Doors of the foregoing type are exemplified by U.S. Pat. No. 2,048,909 (Woodworth). They consist of a plurality of panels each supported in a frame, with adjacent vertical frame members being connected along their length with piano hinges, with one panel being supported from a wall surface.

Various problems arise with the installation of conventional shower doors, resulting from the wall surfaces not being about vertical and horizontal axes to the lip of the bath or shower pan to be enclosed by the door. A further problem arises in adjusting the door to accommodate variations of the width of the opening to be closed.

A still further problem arises where the door is to be supported from a plaster board wall, particularly where there is no underlaying supporting stud, due to the relatively heavy weight of the glass panels and supporting metal framework. This last problem has been largely overcome recently by the adoption of lightweight plastic materials, particularly hollow, fluted plastic panels, and a surrounding framework which is decorative rather than loadbearing. In this type of construction a plurality of vertically spaced apart hinges has been employed, anchored in openings cut into the panels. The openings must be relatively large, in order to delocalize the stress, and considerable difficulty has been experienced in sealing around the openings. Problems have additionally been encountered in providing an adequate seal between the edges of adjacent panels.

Other problems associated with conventional shower doors relate to their use of hardware which forms surface obstructions, and exposed fasteners. These are difficult to maintain clean and reduce the aesthetic appeal of the shower doors.

It is an object of this invention to provide a shower door construction that is easy to install.

It is a further object of this invention to provide a shower door that may be adjusted to accommodate various structural deficiencies and variations in the walls defining the opening to which the shower door is to be installed.

It is a further object of the invention to provide improved sealing means for a shower door.

It is another object of the invention to provide a light, economically produced, durable shower door construction.

It is yet another object of the invention to provide a shower door that is generally devoid of surface obstructions and exposed fasteners.

SUMMARY OF THE INVENTION

In accordance with one aspect of this invention, a shower door assembly comprises first, second and third generally planar, generally rectangular, vertically elongated panels. First and second hinge means are provided, each of the hinge means comprising a hinge spine and a pair of channels supported therefrom, with each channel having a notional central plane therealong. Adjacent edges of the first and second panels are received and secured in sealed relationship in the respective channels of the first hinge means, and the second and third panels are similarly secured to the second hinge means. The first hinge means has its hinge axis offset from the axial plane of the channels, to permit the first and second doors to swing between a generally coplanar position and a parallel, overlapping position. The second hinge means has its hinge axis contained in the axial plane of the channels to permit the second panel to swing relative to the third panel between a coplanar position and a position 90° on each side thereof. Flexible sealing means is associated with each hinge means, the hinge spine, channels and sealing means being substantially coextensive and locating continuously along medial portions of the panels.

The first and second panels are supported from the third panel solely by the hinge means, without the use of overhead tracks. The long, vertically extending channels delocalize the stress forces on the panels, and do not require openings to be formed therein.

Suitably, a bracket is provided comprising a pair of vertically elongated walls spaced apart adjacent one vertical edge by a bight. The walls define a passageway therebetween having an entry thereto along the distal vertical edges thereof within which the distal vertical edge of the third panel is receivable for gripping thereby. Desirably, the front to back dimension of the passageway is several times the thickness of the panel, so permitting an adjustment of the doors in the plane of shut of the door, to accommodate variations in the size of the opening in which the door is to be installed, and also to accommodate walls that are out of vertical. The bracket is generally coextensive with the third panel along the length thereof to provide a continuous seal thereto and also to the supporting wall surface.

Also suitably, the bracket is enlarged in width adjacent the bight, to provide a more stable base for the securement of the bracket to a supporting wall. The bracket may be secured to the wall by any conventional means, which means will be concealed by the wall of the bracket. Preferably, the vertically elongated walls of the bracket project rearwardly of the bight, whereby the bracket has a generally H shaped transverse cross section. The rearward projections may be trimmed as appropriate on site, to tailor the bracket to walls that are not normal in the vertical plane to the desired plane of shut of the door, and minor surface irregularities and to provide an improved seal thereto. The rearward projections may be continuous with the forwardly projecting walls of the bracket, or they may be discontinuous therewith.

Desirably, the bracket walls adjacent to the entrance to the passageway are provided with a gasket for forming a seal on the major surface of the panel received therein. Suitably the gasket comprises a plurality of soft flexible beads coextensive with the vertical walls of the bracket along the length thereof, which may conveniently be coextruded therewith.

The channels of each of the hinges are defined by wall means having a generally U shaped transverse cross-section defined by a bight and side walls upstanding therefrom. Suitably the side walls are provided with a gasket for sealing onto the major surface of the panel received in the channels, such gaskets being conveniently formed by coextrusion in a similar manner to the bracket gaskets described above.

Desirably, sealing means is provided to restrict the passage of water around the spine of the hinges. In the case of the first hinge, the sealing means is conveniently in the form of a thin, resilient diaphragm strip, the vertical sides of which are sealed to the back of the bight of the hinge channel therealong, to form therewith a tube. Conveniently the diaphragm strip is coextruded with the hinge elements in sealed relation thereto. In the case of the second hinge, the sealing means conveniently also is in the form of a diaphragm strip, supported along one vertical edge thereof from a side wall of one of the hinge channels to form a flap for the hinge spine.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
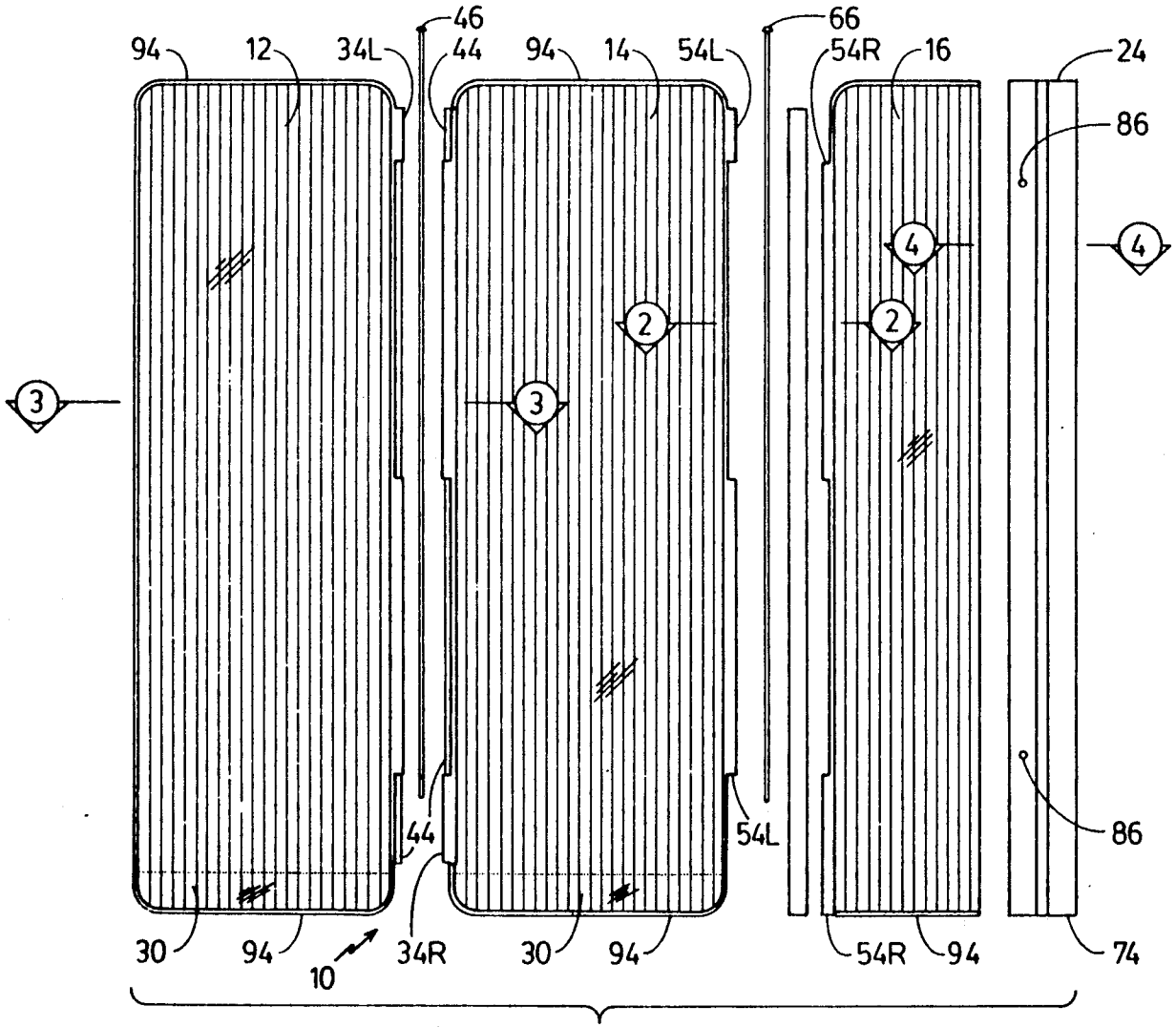
FIG. 1 is an exploded front elevation of the shower door of the invention, as seen from the outside thereof.
Figure 2:
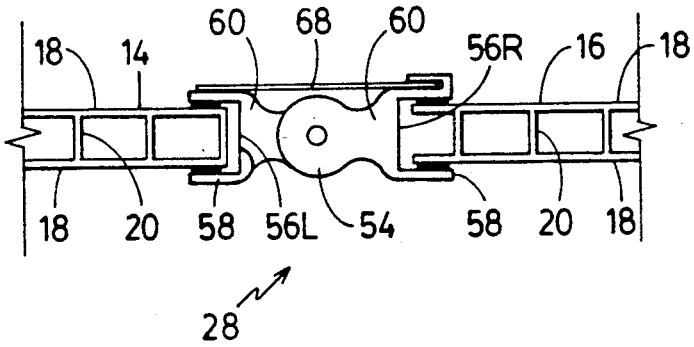
FIG. 2 is a sectional view along line 2—2 of FIG. 1, broken to indicate indefinite length.
Figure 3:
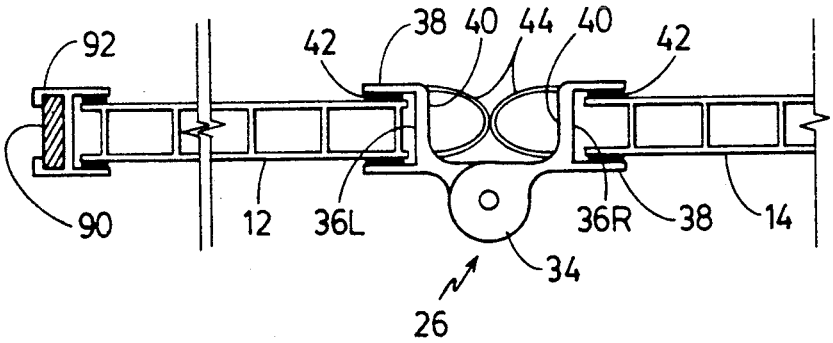
FIG. 3 is a sectional view along line 3—3 of FIG. 1.
Figure 4:
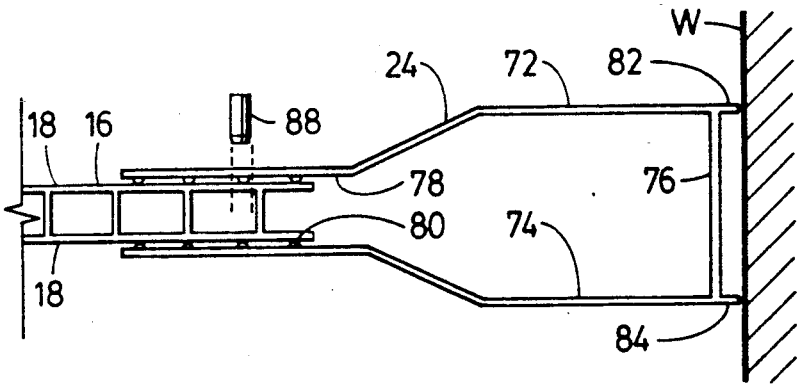
FIG. 4 is a sectional view along the line 4—4 of FIG. 1.

Referring now to the drawings in detail, a shower door assembly is identified generally therein by the numeral 10. Assembly 10 comprises first, second and third panels, respectively 12, 14 and 16 each of which are hollow and have opposed major surfaces 18 separated by flutes 20. Panel 16 is adapted for support in fixed relation to a wall surface W by means of a bracket 24, and panels 14 and 12 are swingingly supported entirely from panel 16 by means of a first hinge 26 which interconnects panels 12 and 14, and a second hinge 28 which interconnects panels 14 and 16.

Panels 12, 14 and 16 are generally rectangular and vertically elongated. All four corners of the swinging panels 12 and 14 are rounded for pleasing effect, whereas the upper two corners only of fixed panel 16 are similarly contoured. The lower several centimetres of swinging panels 12, 14 are inwardly deformed at 30 to form a watershed into a bath or shower pan (not shown) enclosed by the door assembly.

Hinges 26, 28 extend substantially along the length of panels 12 and 14 between the contoured upper corners and watershed 30, thereby delocalizing the stress forces at the interface between the hinges and panels.

Hinge 26 comprises a hinge spine 34 formed by left segment 34L and right segments 34R, as seen in the Figures, which butt together whereby they conjointly extend along the length of the hinge. From each segment 34L there is supported a channel 36L; similarly a channel 36R is supported from right spine segment 34R. Channels 36L, 36R extend continuously along the length of hinge spine 34. Channels 36L, 36R are each defined by wall structure having a generally rectangularly U shaped transverse cross section defined by side walls 38 interconnected by a bight wall 40. Each side wall 38 is formed with a soft, resilient bead 42 extending continuously therealong which forms a seal against the surface 18 of panels 12 and 14 when inserted into the respective channels. Suitably an adhesive is employed to anchor the channels 36L, 36R onto the panels. A flexible tubular sealing element 44 extends continuously along each bight wall 40 and has a wall portion in common therewith. Hinge spine 34 has a central opening therethrough through which extends a hinge pin 46 defining the hinge axis. Hinge 26 has its axis forwardly offset from the plane of shut of panels 12, 14, thereby permitting panel 12 to swing through an arc of 180° and lay flat against panel 14 where it is desired to provide greater access to a bath or shower enclosed by the shower door.

Second hinge 28 comprises a spine 54 formed of segmented portions 54L, 54R in analogous manner to hinge 26. Also in an analogous manner, hinge 28 comprises left or right channels respectively identified as 56L, 56R extending continuously along the length of the spine 54 which channels comprise a side wall 58 interconnected by a bight wall 60 systematically connected to spine portions 54L, 54R. Panels 14,16 are sealed to channels 56L, 56R in analogous manner to that earlier described in relation to hinge 26. Hinge spine 54 has a central opening therethrough through which extends a hinge pin 66 defining the hinge axis. Hinge 28 has its axis in the panel 14 to swing through an arc of at least 180° between positions wherein it is generally at right angles forwardly and rearwardly of the plane of panel 16. One side wall 58 of channel 56R is provided with a slot therealong within which is received a flat sealing strip 68.

In practise and preferably, the left and right portions of hinge 26 are formed from identical extrusions which are subsequently profiled to form the mating segmented spine portions 34L, 34R. Similar the left and right portions of hinge 28 preferably formed from identical extrusions profiled to form the segmented spine portions 54L, 54R.

Bracket 24 comprises a pair of walls 72,74 spaced apart by a bight 76 to define a passageway 78 therebetween. Passageway 78 has a width adjacent the entrance thereto marginally less than the thickness of panel 16 whereby the walls of bracket 24 will grip panel 16 when inserted into passageway 78. The walls 72,74 are each provided with soft sealing beads 80 therealong adjacent the entrance to passageway 78. Passageway 78 is substantially wider adjacent bright 76 than adjacent the entrance to the passageway, so as to form a relatively wide base. Walls 72,74 extend rearwardly beyond bight 76 to form small legs 82,84.

Bracket 24 is secured to wall W by means of screws (not shown). Not unusually, wall W will not extend at right angles to the intended shut of shower door assembly 10. This may be easily compensated for by suitably trimming one or other of legs 82,84. Similarly where wall W is not vertically plumb, both legs 82,84 could be trimmed. However, an easier mode of compensation is provided for whereby panel 16 as a whole may be rotated in a vertical plane relative to bracket 24.

For enclosing a bath of usual length, two shower door assemblies 10 would be employed together to form left and right mirror image enclosure portions. For a shower entrance door a single assembly may suffice. In either case, the width of the opening into which the door assemblies or assembly is to be fitted will vary according to the particular installation. Bracket 24 permits a ready means of adjustment for the width of the door assembly, according to the extent to which panel 16 is inserted into passageway 78, when the width of the door has been adjusted and compensation allowed for out of plumb walls W, panel 16 is secured in place by drilling openings 86 through the panel and bracket walls and inserting pins 88 therethrough.

Door assemblies 10 will usually be provided with handle means, (not shown) which may include a closure means. A suitable closure means is provided by a magnetic strip 90 which extends along the free vertical edge panel 12, and which is retained in position therealong by a double channelled extrusions 92. All exposed edges of panels 12, 14 and 16 are trimmed with a decorative channel 94 which serves to seal the interior of the panels. Channel 94 does not provide any structural strength to the panels or to the door assembly as a whole.

It will be apparent that many changes may be made to the illustrative embodiment, while falling within the scope of the invention and it is intended that all such changes be covered by the claims appended hereto.

I claim:

1. A frameless shower door assembly comprising:

first, second and third generally planar, generally rectangular, vertically elongated panels, each having a top edge, a bottom edge and two side edges;

first and second hinge means each comprising a hinge spine and a pair of channels supported therefrom;

each said channel having a central axial plane therealong;

adjacent side edges of said first and second panels being received and secured in sealed relationship to respective channels of said first hinge means;

adjacent side edges of said second and third panels being received and secured in sealed relationship to respective channels of said second hinge means;

said first hinge means having a hinge axis thereof offset from the central axial plane of associated said channels, to permit said first and second panels to swing between a coplanar position and a parallel, overlapping position; said second hinge means having a hinge axis thereof contained in the axial plane of associated said channels to permit said second panel to swing relative to said third panel between a coplanar position and 90° on each side thereof;

flexible sealing means associated with each said hinge, said hinge spine, channels and sealing means being substantially coextensive and located continuously along medial portions of said panels; means for securing said third panel to a wall surface, and said first and second panels being supported from said third panel solely by means of said hinge means.

2. A frameless shower door assembly as defined in claim 1, wherein said securing means comprises a vertically elongated bracket means for adjustably securing said third panel to said wall surface.

3. A frameless shower door assembly as defined in claim 1, wherein said bracket means comprises a pair of walls spaced apart by a bight adjacent one vertical edge thereof to define a passageway therebetween, distal portions of said walls defining an entrance to said passageway within which a vertical edge of said third panel remote from said second hinge means is receivable for gripping thereby.

4. A frameless shower door assembly as defined in claim 3, wherein said bracket has a front to back dimension extending between said bight and said distal edges several times greater than the width of said entrance to said bracket.

5. A frameless shower door assembly as defined in claim 3, wherein said bracket has a greater width adjacent said bight than at said entrance.

6. A frameless shower door assembly as defined in claim 3, wherein said walls extend rearwardly of said bight.

7. A frameless shower door assembly as defined in claim 3, wherein said walls adjacent the entrance to said passageway are provided with a gasket means for sealing onto the surface of said third panel when engaged in said passageway.

8. A frameless shower door assembly as defined in claim 7, wherein said gasket sealing means comprises a plurality of soft flexible beads coextensive with said walls along the length thereof.

9. A frameless shower door assembly as defined in claim 1, wherein said channels are defined by wall means having a generally U shaped transverse cross-section defined by a bight and side walls upstanding therefrom, and wherein said side walls are provided with at least one soft, resilient bead extending continuously therealong on the interior of said channel to provide a seal against a panel inserted into said channel.

10. A frameless shower door assembly as defined in claim 9, wherein said soft resilient bead is coextensive with said channel along the length thereof.

11. A frameless shower door assembly as defined in claim 9, wherein said flexible sealing means associated with said first hinge means is formed continuously along said bight.

12. A frameless shower door assembly as defined in claim 11, wherein said flexible sealing means is tubular and has a wall portion in common with said bight.

13. A frameless shower door assembly as defined in claim 12, wherein said flexible sealing means is coextensive with said channel along the length thereof.

14. A frameless shower door assembly as defined in claim 1, wherein each said hinge spine consists of four coaxially aligned segments.

15. A frameless shower door assembly as defined in claim 4, wherein each said hinge means includes a removable hinge pin coextensive with a said spine associated therewith.

16. A frameless shower door assembly as defined in claim 1, wherein at least said first and second panels are hollow fluted panels.

17. A frameless shower door assembly as defined in claim 1, further comprising channel means having a generally H-shaped cross-section defining back to back channels, in one of which there is received and secured in sealed relation the distal edge of said first panel and in the other of which there is secured a magnetic strip gasket, said channel means extending continuously along medial portions of said distal edge.

18. A shower door comprising two door assemblies as defined in claim 1, one said door assembly being the mirror image of the other.

* * * * *